US005886673A

United States Patent [19]

Thomas

[11] Patent Number: 5,886,673

[45] Date of Patent: Mar. 23, 1999

[54] APPARATUS AND METHOD FOR IMPROVING PORTABILITY OF SATELLITE ANTENNAS

[76] Inventor: Pat Thomas, 1820 E. Whisperwood Cir., Sandy, Utah 84092

[21] Appl. No.: 658,148

[22] Filed: Jun. 4, 1996

[51] Int. Cl.[6] ..... H01Q 3/02

[52] U.S. Cl. ..... 343/882; 343/878

[58] Field of Search ..... 343/860, 878, 343/882, 892, 890, 765; 248/183, 300, 674

[56] References Cited

U.S. PATENT DOCUMENTS

| | | | |
|---|---|---|---|
| 4,185,288 | 1/1980 | Dosch et al. | 343/765 |
| 4,490,726 | 12/1984 | Weir | 343/840 |
| 4,811,026 | 3/1989 | Bissett | 343/766 |
| 4,887,081 | 12/1989 | Iihoshi et al. | 340/995 |
| 4,931,809 | 6/1990 | Putman et al. | 343/892 |
| 5,166,696 | 11/1992 | Rupp et al. | 343/711 |
| 5,212,493 | 5/1993 | Cluniat et al. | 343/765 |
| 5,337,062 | 8/1994 | Sherwood et al. | 343/711 |
| 5,418,542 | 5/1995 | Sherwood et al. | 343/711 |
| 5,419,521 | 5/1995 | Matthews | 343/765 |
| 5,473,335 | 12/1995 | Tines | 343/766 |
| 5,515,065 | 5/1996 | Sherwood et al. | 343/882 |
| 5,526,010 | 6/1996 | Plunk | 343/882 |
| 5,554,998 | 9/1996 | Sherwood et al. | 343/763 |
| 5,585,809 | 12/1996 | Yajima et al. | 343/878 |
| 5,617,680 | 4/1997 | Beatty | 343/892 |
| 5,647,567 | 7/1997 | Pugh, Jr. et al. | 343/882 |

OTHER PUBLICATIONS

Shakespear—New for '96 p. 3 (Publication date unknown).

*Primary Examiner*—Don Wong
*Assistant Examiner*—Tan Ho
*Attorney, Agent, or Firm*—Thorpe, North & Western, L.L.P.

[57] ABSTRACT

An adapter for facilitating the portability of satellite antennas includes a first side adapted for attachment to a satellite base and a second side adapted to releasably engaging a base unit. A plurality of base units are typically attached to desired locations for the satellite antenna, such as a home, recreational vehicle, cabin or boat. By simply releasing the adapter from the base unit, the satellite antenna may be conveniently moved to another desired location. To further facilitate transport, the receiver arm of the satellite antenna can be modified to readily fold inwardly with the release of a pin.

16 Claims, 6 Drawing Sheets

APPARATUS AND METHOD FOR IMPROVING PORTABILITY OF SATELLITE ANTENNAS

BACKGROUND OF THE INVENTION

1. Field of the Art

The present invention relates to an apparatus and method for use with a base unit and a compact satellite antenna to enable the satellite antenna to be conveniently moved and mounted between a home and other places of use such as cabins, boats and recreational vehicles. In particular, the present invention relates to an adapter which enables the quick release and mounting of the base of such a satellite antenna to a base unit secured on a building, boat or vehicle.

2. State of the Art

The use of satellite dishes has become increasingly common over the last two decades. While the dishes used to be large and infrequently used, technology has decreased the size of the satellite dishes and significantly increase the amount of information which may be obtained with a satellite dish. One area which has experienced especially significant growth has been the use of satellite dishes to receive entertainment programming. Although satellite dishes have traditionally been expensive, the dishes are advantageous in that they avoid the need to run cables and can therefore be used in even very remote locations.

Until recently, most satellite dishes measured five or six feet across and were not readily moveable. However, recent advances in commercialized technology have lead to explosive growth in small digital satellite dishes, commonly referred to as digital satellite systems or "DSS". The DSS dishes typically measure 18 inches to two feet across and can be easily lifted by an adult. The DSS antennas are particularly advantageous in that they may be mounted on the sides of buildings or even on balconies, as opposed to the considerable space occupied by their predecessors. The decrease in size also brought the cost of such devices down to a level which is economically feasible for most families. Instead of selling for three to four thousand dollars, as had the large dishes, the small digital satellites typically sell for seven to eight hundred dollars.

Referring now to FIG. 1, there is shown a perspective view of a DSS antenna, generally indicated at 4. The antenna 4 includes a dish 10, its accompanying receiver arm 20 for holding a receiver 24, and support arm 30. The dish 10 is typically attached to the side of a house, etc., by four bolts 40 which extend through a base plate 50 at the bottom of the support arm 30. The bolts securely hold the base 30, and thus the dish 10, to prevent the antenna 4 from being damaged during storms and the like. Thus, the bolts must be firmly anchored in a mounting surface 60, such as a roof. A cable 70 carries the received signals to a processing module (not shown) and then on to the television set (not shown).

Due to the significant improvements achieved by the DSS antennas, many users desire to use the dishes to receive entertainment programming in locations other than their homes. For example, many people who own recreational vehicles such as motor homes desire to receive the programming available over the DSS antenna. However, prior to the present invention, the use of the DSS antennas on motor homes raised two significant concerns. First, a second antenna must be purchased. While the price of the antenna is significantly less than the large dishes previously available, purchasing the second antenna and having it mounted on the motor home can still cost nearly a thousand dollars. Second, the DSS antenna creates a significant amount of drag on the recreational vehicle when moving. Therefore, the antenna should be removed prior to driving the recreational vehicle. However, if the satellite base is boltedly attached to the vehicle, removal of the DSS antenna can be difficult and can consume a considerable amount of time.

Several inventions have been made to reduce the drag created by the antenna. For example, in U.S. Pat. No. 4,811,026, there is shown a satellite antenna which can be compacted for traveling. While such an antenna reduces drag, it is more expensive than a standard antenna and still requires the purchase of a separate antenna for the recreational vehicle.

The cost and lost time of removing the DSS antenna from the motor home is equally applicable to cabins, houseboats, and other watercraft. While the DSS antenna will generally not create a significant amount of drag at the speeds commonly traveled by boats, most owners will desire to remove the DSS antenna when the boat is not in use in order to prevent theft.

Thus, there is a need for an adapter which enables the base plate 50 of the support arm 30 of the satellite antenna 4 to be conveniently attached and detached from a base unit mounted on a house, a cabin, a recreational vehicle or a boat. Such a base would typically include a rotatable member which allows the user to position the satellite in a desired direction.

Such an adapter should enable the user to use a single DSS antenna at his or her home, at a cabin, on a recreational vehicle and on a boat. To move the DSS antenna, the adapter need only be removed from the base unit it is mounted on, and slid into a similar base unit disposed on the recreational vehicle, boat, etc. If travel is involved prior to use, the DSS antenna should be storable in the boat or recreational vehicle until arrival at the desired location.

Furthermore, such an adapter should be attachable to a base unit on a boat or recreational vehicle which is rotatable. Such a base unit would enable the DSS antenna to be rotated until the dish is disposed in the desired orientation.

SUMMARY OF THE INVENTION

Thus, it is an object of the present invention to provide an adapter which enables a user to conveniently transfer a single satellite antenna between a residence, a recreational vehicle or a boat.

It is another object of the present invention to provide such an adapter which enables a DSS antenna to be removed without the use of tools.

It is yet another object of the present invention to provide such an adapter which is inexpensive and easy to use.

It is still another object of the present invention to provide an adapter which interacts with a base unit which rotates to allow the antenna to be oriented as desired by the user.

It is still yet another object of the present invention to provide a method for enabling use of a DSS antenna on a plurality of different locations without the need for tools.

The above and other objects of the invention are realized in specific illustrated embodiments of an adapter for securing portable satellites and a method for using the same. The adapter includes an adapter body having a first side and a second side. The first side of the adapter body is adapted to receive a plurality of bolts for fixedly attaching the adapter to the support arm of a DSS antenna. This is typically accomplished by attaching the first side to a base plate disposed at the bottom of the support arm. The second side of the adapter body is adapted to slidably engage a base unit which is fixedly attached to a building, a boat, a recreational vehicle or some other support surface. When the second side is disposed so as to slidably engage the base unit, the DSS antenna is firmly attached to the building, etc. To relocate the DSS antenna to another location, the second side of the adapter body is detached from the base unit, thereby rendering the DSS antenna unattached and transportable.

In accordance with one aspect of the invention, the base unit comprises a locking mechanism for selectively holding the second side of the adapter body in the base unit. Preferably, the locking mechanism contains a quick-release so as to enable the locking mechanism to be unlocked without the use of tools, thereby enabling the second side to be removed from the base unit.

In accordance with another aspect of the invention, a base unit is fixedly disposed on each building, boat and recreational vehicle with which the satellite antenna will be used. Thus, there is no need to transport the base unit between locations or to detach the base unit from the building, boat or recreational vehicle to which it is attached.

In accordance with yet another aspect of the present invention, the base unit includes a rotation mechanism so that the base unit can rotate to a position in which the satellite antenna attached thereto can be conveniently oriented for maximum reception.

Another aspect of the invention involves the modification of the receiver arm which holds the receiver in front of the satellite dish so as to enable the receiver arm to be pivoted toward the dish or the support arm for transport. Typically, a retention pin will be used to hold the receiver arm in place when the satellite antenna is in use, and removed when transported to improve portability.

In accordance with another aspect of the present invention, the adapter can be configured to serve as both the base plate and the adapter. Thus, the adapter is pivotably attached to the support arm rather than being bolted to the base plate.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims.

Figure 1:
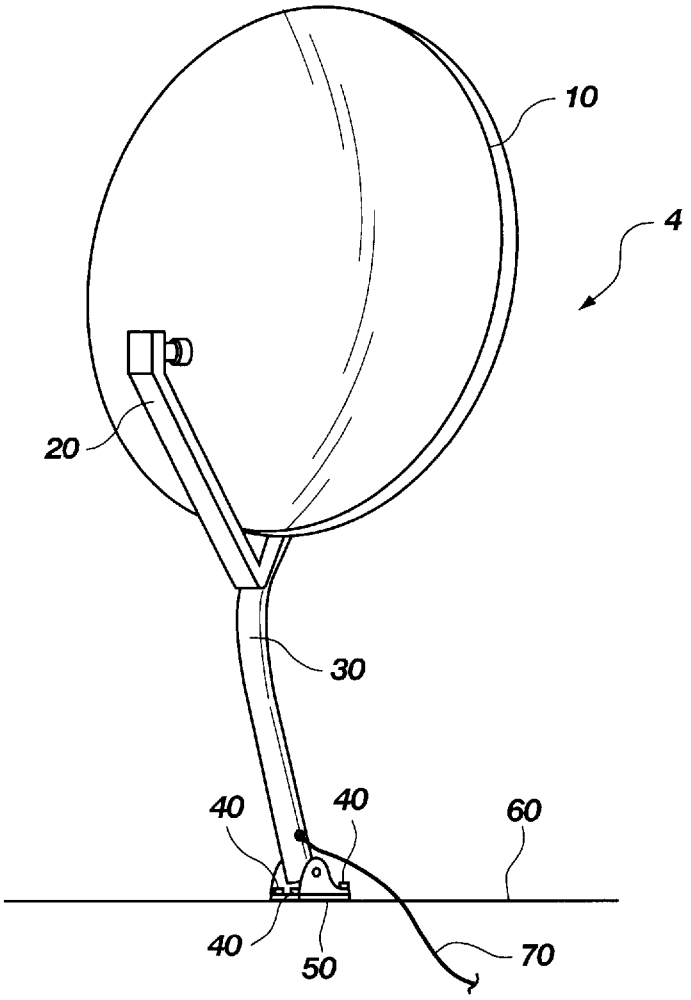
Fig. 1 (PRIOR ART)
FIG. 1 shows a perspective view of a DSS satellite antenna made in accordance with the teachings of the prior art.
Figure 2:
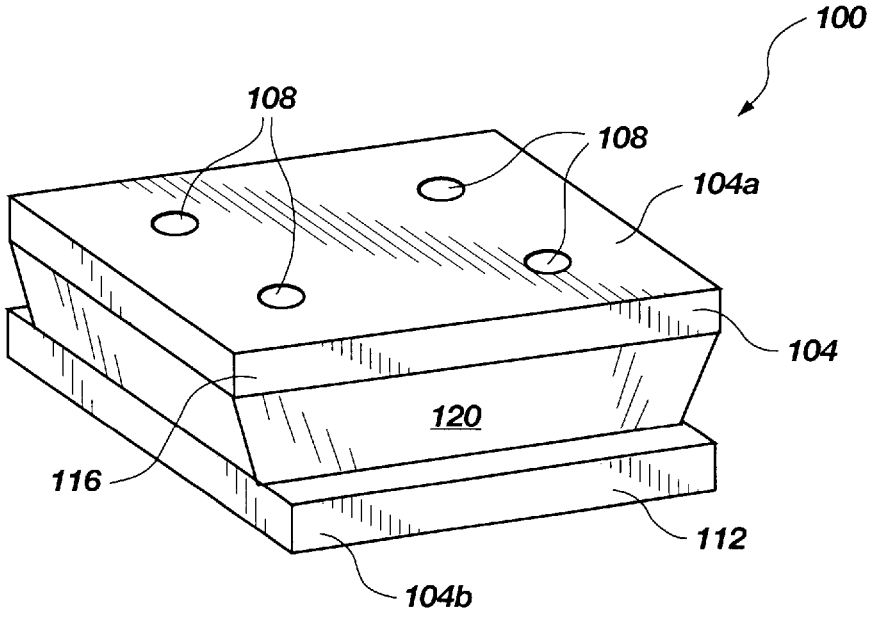
FIG. 2 shows a perspective view of an adapter made in accordance with the principles of the present invention.

Referring to FIG. 2, there is shown a perspective view of an adapter, generally indicated at 100, made in accordance with the teachings of the present invention. The adapter 100 includes an adapter body 104 which is typically made of a lightweight composite or plastic, but which may be made of any number of generally rigid, durable materials.

Figure 3:
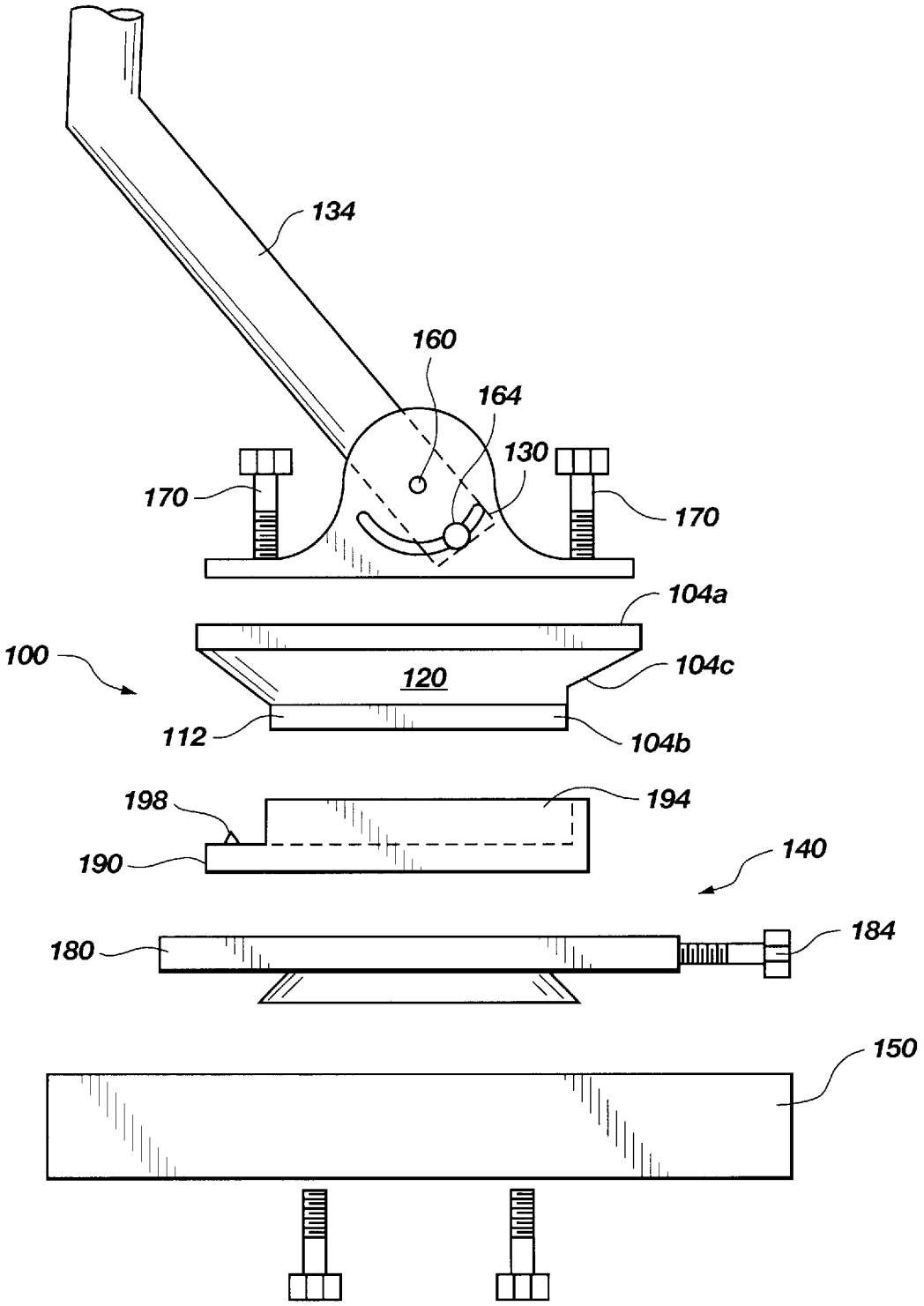
FIG. 3 shows an exploded side view of the base of the DSS antenna, the adapter of FIG. 2, and the components of the base unit.

A plurality of holes 108 are formed in a first side 104*a* of the adapter body 104 to receive bolts (FIG. 3) which extend through the base plate (FIG. 3) of the DSS support arm (FIG. 3). Preferably, the adapter body 104 is fixedly attached to the base plate of the support arm of the DSS antenna and is carried with the antenna as the antenna is relocated from base unit to base unit.

Disposed on an opposing, second side 104*b* of the adapter body 104 is a flange 112, the outer perimeter of which is generally coextensive with the outer edge 116 of the first side 104*a* of the housing. Thus, the flange 112 is formed by an inward taper in the central section 120 of the adapter body. As will be explained in additional detail below, the second side 104*b* of the adapter body 104 slidably engages the base unit to anchor the satellite antenna in place. However, because the adapter body 104 can be readily removed from the base unit, the satellite antenna is removable without the use of tools.

Referring now to FIG. 3, there is shown an exploded side view of the adapter 100; a base plate 130 which is attached at the bottom of a support arm 134 which holds the satellite dish (not shown) in place; a base unit, generally indicated at 140, and a support structure 150 to which the base unit 140 is attached.

The base plate 130 is typically attached to the support arm 134 by a rivet 160, and by an adjustable nut 164. Loosening the adjustable nut 164 allows the user to change the angle of the support arm 134, and thus change the angle of the satellite dish which it supports. The adjustability of the angle of the satellite dish is especially desirable when the satellite antenna will be used in several different locations.

The base plate 130 is attached to the adapter body 104 by a plurality of bolts 170. The bolts 170 extend through the base plate 130, and into the adapter body 104. Thus, rather than being bolted to a surface such as a roof, the base plate is bolted to the movable adapter 100.

The base unit 140, as shown in FIG. 3, includes a rotatable base 180. The rotatable base 180 includes a spring loaded pin 184 which, when released, prevents the rotatable base from rotating. To allow rotation, the spring loaded pin 184 must be pulled slightly and then a small amount of force applied to the rotatable base. Such rotatable bases 180 are commonly available. One type which has been found to be particularly useful are rotatable bases which are formed for downrigger arrangements. The rotatable bases are very durable, but are compact enough that they are generally not noticeable when mounted to the top of a recreational vehicle or other location of use.

The rotatable base 180 is mounted onto the support structure 150, which may be the roof of a recreational vehicle, a boat, or the deck of a house or cabin. Preferably, the rotatable base 180 is bolted to the support structure 150 in such a manner that the rotatable base cannot easily be removed.

Attached to the top of the rotatable base 180 is an adapter housing 190 which is configured to receive the second side 104*b* of the adapter body 104. As shown in FIG. 3, one end 104*c* of the adapter body can be specially contoured to fit in the adapter housing 190, thereby ensuring that the adapter body 104 is mounted into the adapter housing in a desired direction.

The adapter housing 190 can be integrally formed with the rotatable base 180, and such housings are generally available with downrigger rotatable bases. If there is no need to rotate the satellite, for example, at a cabin, the adapter housing 190 can be used without the rotatable base 180. In such a situation, the adapter housing 190 can be bolted directly to the support surface 150.

The adapter housing 190 shown in FIG. 3 includes a channel 194 into which the second side 104*b* of the adapter body 104 is slid to anchor the adapter body and thus the satellite antenna. The adapter housing 190 includes a pair of inwardly extending flanges (FIG. 4) which engage the outwardly extending flange 112 of the second side 104*b* of the adapter body 104. The flanges of the adapter body 104 and the adapter housing 190 interact to allow removal of the adapter body from the adapter housing only by sliding the adapter body horizontally. A locking mechanism 198 can be provided to limit the ability of the adapter body 104 to slide horizontally out of the adapter housing 190. Preferably, the locking mechanism 198 has a quick release which allows the user to withdraw the adapter body 104 from the adapter housing 190 without the need for tools. Such a quick release can be a spring loaded mechanism, or some easily releasable device, such as a wing nut.

With such an arrangement, the support arm 134 of the satellite antenna can be attached or removed from the support structure within a matter of seconds. No bolts need to be removed, and no tools are required. The rotatable base 180 and the housing adapter 190 of the base unit 140 remain in place so there is never any question as to the proper location for attaching the satellite antenna.

Figure 4:
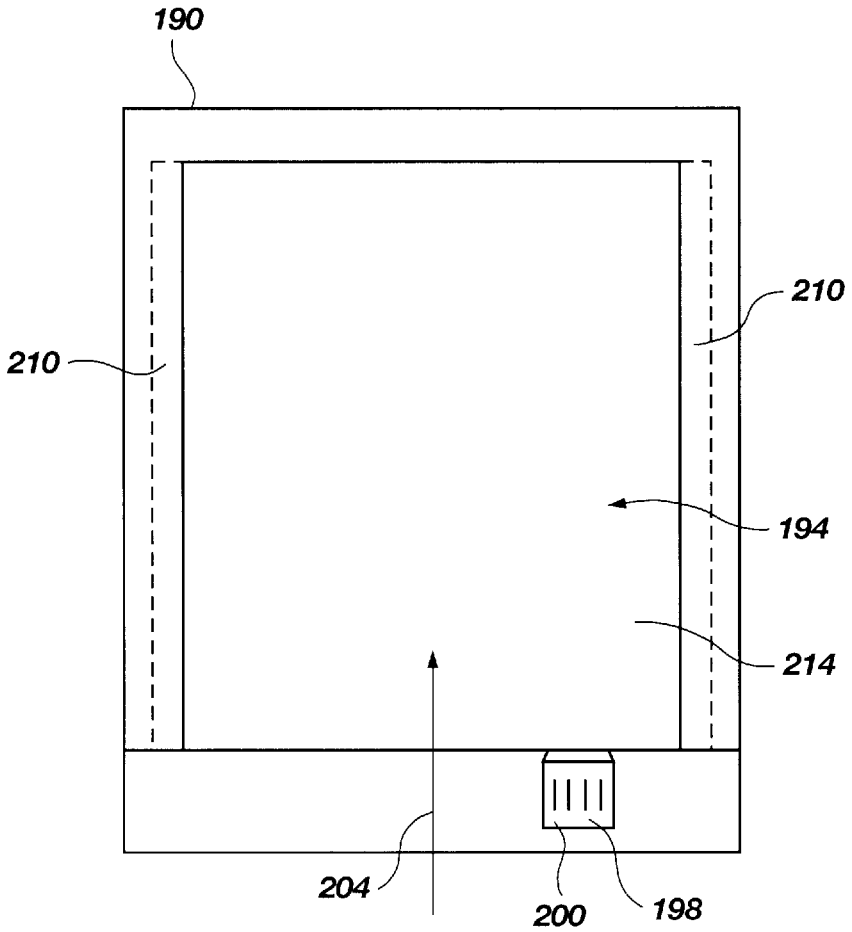
FIG. 4 shows a plan view of a base unit for receiving the adapter in accordance with the principles of the present invention.

Referring now to FIG. 4, there is shown a plan view of the adapter housing 190. The adapter housing 190 has a channel, generally indicated at 194, for receiving the adapter body 100 (FIG. 2). In order to receive the adapter body 100, the locking mechanism 198 is moved into a nonlocking position. As shown in FIG. 4, the locking mechanism 198 includes a spring loaded catch 200. In order to slide the adapter body 104 into the channel 194 in the adapter housing 190, the catch 200 is depressed and a horizontal force applied to the adapter body in the direction indicated by arrow 204. As the adapter body 104 slides into the channel 194 in the adapter housing 190, the flange 112 of the adapter body slides below the inwardly extending flanges 210 of the adapter housing. Thus, the flange 112 of the adapter body 104 is held between the flanges 210 and the floor 214 of the adapter housing 190. Securing the flange 112, of course, secures the remainder of the adapter body 104. Thus, by sliding the adapter body 104 into the channel 194, the satellite antenna becomes securely attached to the support surface 150 (FIG. 3). The spring loaded catch 200 prevents the adapter from accidentally sliding out of the adapter housing 190 in the event that the satellite antenna is bumped or subjected to some other force.

To remove the adapter body 104 from the adapter housing 190, the spring loaded catch 200 is depressed and the adapter body is slid in a direction opposite the arrow 204. Once the adapter body 104 is at least partially disposed over the spring loaded catch 200, the weight of the adapter body will hold the catch down until the adapter body has been completely removed from the channel 194.

Figure 5:
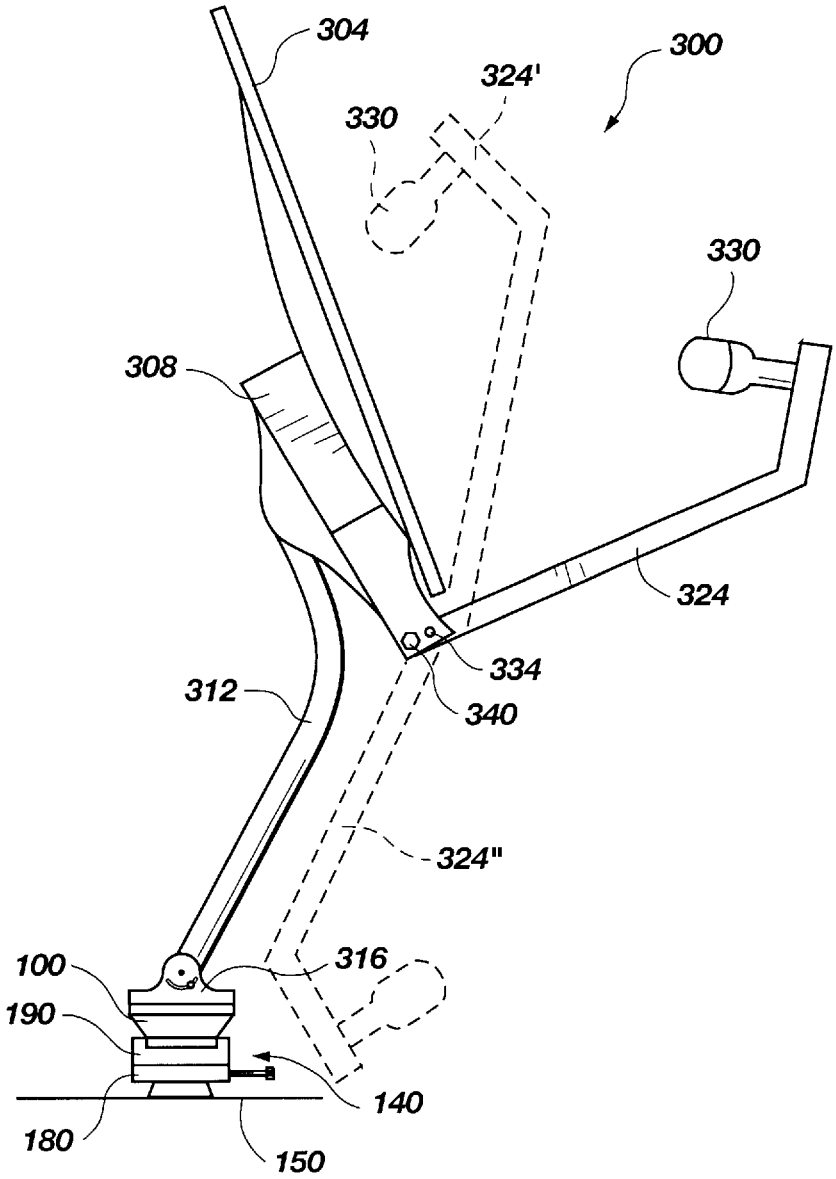
FIG. 5 shows a side view of a DSS satellite antenna modified in accordance with the teachings of the present invention.

Referring now to FIG. 5, there is shown a side view of a satellite antenna, generally indicated at 300, attached to an adapter 100. The adapter 100 is mounted in the base unit 140, which is, in turn, attached to the support surface 150.

The satellite antenna 300 includes a dish 304 which is connected by a frame 308 to a support arm 312. The support arm 312 includes a base plate 316 which enables change in the angle at which the support arm is held. Extending from the frame 308 is a receiver arm 324 which a receiver 330 in front of the dish 304. The receiver arm 324 in prior art satellite antennas is usually attached to the frame 308 by a pair of rivets, such as rivet 334, on each side.

One problem with transporting satellite antennas is that the receiver 324 extends outwardly from the remainder of the antenna in such a manner that storage of the antenna during transport can be difficult. While compactable satellites have been made, they are traditionally expensive and often require tools to erect or compact.

It has been found in accordance with the one aspect of the present invention that conventional satellite antennas can easily be modified by removing the rivets and drilling holes through the arm. A removable retention pin 340 is then placed in one of the holes, and a bolt is placed in the other to secure the receiver arm 324 in the position shown in FIG. 5. When the user desires to relocate the satellite dish 304, removal of the retention pin 340 the facilitates movement of the receiver arm from a first, conventional position to a second, compact position adjacent the dish 304, as indicated by the dashed FIG. 324', or into a third, compact position adjacent the support arm 312 as indicated by the dashed FIG. 324". The adapter 100 which is attached to the base plate 326 of the support arm is then slid out of the adapter housing 190, and the satellite antenna may be conveniently transported to the next desired location. Unlike other collapsible antennas, the satellite antenna shown in FIG. 5 is simpler to use, generally less expensive, and requires less time to set up and take down.

Figure 6:
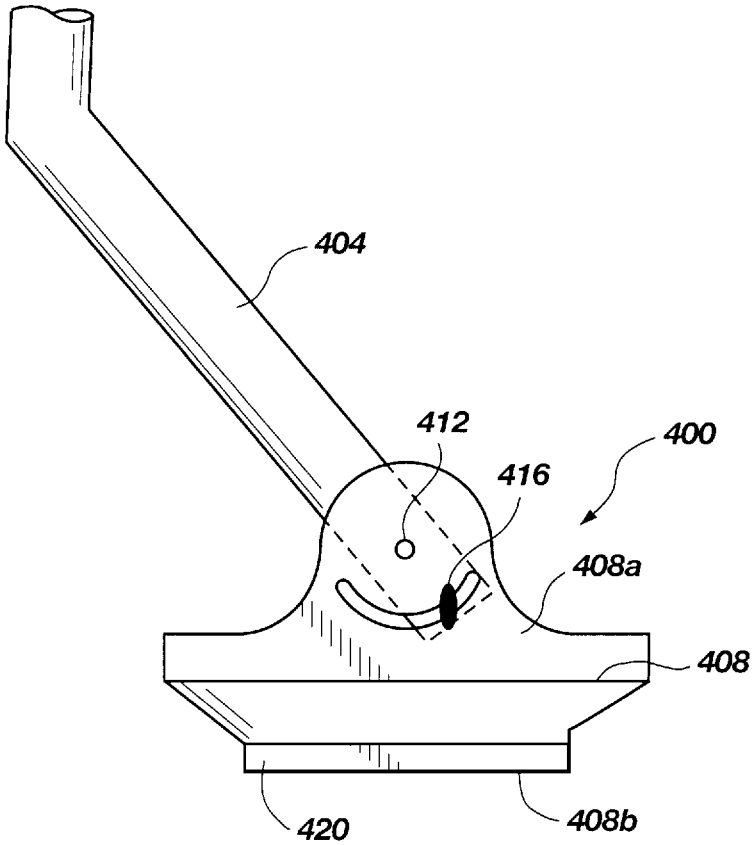
FIG. 6 shows a side view of an alternate embodiment of the present invention.

Referring now to FIG. 6, there is shown an alternate embodiment of the present invention. The adapter, generally indicated at 400, is adapted for attachment to a support arm 404. Unlike the prior embodiments, the adapter has an adapter body 408 with a first side 408*a* which is configured for attachment to the support arm 404 of the satellite antenna. Preferably, the first side 408*a* is attached to the support arm by a bolt 412, or some analogous device, to enable the support arm to pivot with respect to the adapter 400. An adjustment mechanism, such as a wing nut 416 or a bolt, is also provided for selectively connecting the support arm 404 to the first side 408*a* of the adapter body 408. By loosening the wing nut 416, the user can change the angle of the support arm, and thus the orientation of the satellite dish (not shown).

The adapter body 408 also has a second side 408*b*, disposed opposite the first side 408*a*. The second side 408*b* has a flange 420 disposed therein for engaging the adapter housing (FIG. 4). Of course, modifications could be made to the second side 408*b* of the adapter body 408 and to the adapter housing to change the mechanism by which they engage one another.

The adapter 400 shown in FIG. 6 is used in the same manner as is described above. The second side 408*b* is slid into the adapter housing so that the flange 420 engages the structure of the adapter housing which defines the receiving channel. Typically, this will be the flanges discussed with respect to FIG. 4, although other mechanisms could be used. When the second side 408*b* is securely nested within the housing, the satellite antenna is securely held so that it can withstand weather and other forces without falling over. However, by simply releasing the locking mechanism (if provided) and sliding the second side 408*b* of the adapter body 408 out of the adapter housing, the satellite antenna can be easily removed and transported to a new location.

Thus there is disclosed an improved adapter for securing portable satellite antennas and methods for using the same. Those skilled in the art will appreciate that numerous other configurations could be used to secure the adapter body to the adapter housing. Additionally, the adapter housing could be formed so as to serve as an adapter body which can grip onto the base plate 130 of the satellite antenna. Furthermore, those skilled in the art will recognize additional modifications which can be made to the adapter and method of use. The appended claims are intended to cover such modifications.

What is claimed is:

1. A method for releasably attaching a satellite antenna to a support structure, the method comprising:

a) selecting a satellite antenna having a base plate;

b) selecting an adapter configured for attachment to the base plate c) fixedly attaching the adapter to the base plate;

d) selecting a base unit which releasably receives the adapter, the base unit including a rotatable base member and having an adapter housing into which the adapter can be placed only by horizontal movement of the adapter;

e) fixedly attaching the base unit to the support structure; and f) releasably attaching the adapter to the base unit by sliding the adapter horizontally into the adapter housing to thereby secure the satellite antenna to the support structure.

2. The method of claim 1, wherein step (b) comprises, more specifically, selecting said adapter having a generally planar first side with a plurality of holes formed therein.

3. The method of claim 2, wherein step (c) comprises, more specifically, bolting the adapter to the base plate of the satellite antenna.

4. The method of claim 1, wherein step (e) comprises, more specifically, bolting the base unit to the support structure.

5. The method of claim 1, wherein step (d) comprises, more specifically, selecting said base unit having the adapter housing which is configured to releasably receive at least a portion of the adapter.

6. The method of claim 1, wherein the step (d) comprises, more specifically, selecting said adapter housing having a locking mechanism for selectively locking the adapter within the adapter housing.

7. The method of claim 6, wherein the locking mechanism is a spring loaded catch, and wherein the method further comprises pressing the spring loaded catch downwardly to move the catch out of the way of the adapter, and sliding the adapter into the adapter housing.

8. An adapter mechanism for releasably attaching a satellite antenna to a support surface, the satellite antenna having a support arm including a base plate, the adapter comprising:

a base unit comprising an adapter housing configured for releasably receiving at least a portion of an adapter body;

attachment means for securing the base unit to the support surface; and said adapter body having a first side configured for attachment to the base plate of the satellite antenna support arm and a second side configured for slidable disposition at least partially within the adapter housing of the base unit such that when the second side of the adapter body is disposed in the adapter housing, the base plate of the satellite antenna is attached to the support surface and wherein the base unit further comprises a rotatable base member disposable between the adapter housing and a support surface, the attachment means being connectable to the rotatable base member.

9. The adapter mechanism of claim 8, wherein the adapter housing comprises a channel formed therein and a plurality of flanges extending inwardly adjacent the channel, and wherein the second side of the adapter body comprises a peripheral flange disposed so as to engage the flanges of the adapter housing when the adapter body is disposed in the channel.

10. The adapter mechanism of claim 9, wherein the adapter further comprises locking means for selectively holding the second side of the adapter body within the channel in the adapter housing.

11. The adapter mechanism of claim 8, wherein the adapter body further comprises a contoured central section disposed between the first side and the second side.

12. The adapter mechanism of claim 8, wherein the adapter body is made of a composite material.

13. The adapter mechanism of claim 8, wherein the adapter body is made of plastic.

14. An adapter for connecting the support arm of a satellite antenna to a base unit connected to a support surface, the adapter comprising:

an adapter body having a first side configured for fixed attachment to the support arm of the satellite antenna and a second side, opposite the first side, configured for slidable releasable attachment to the base unit, wherein the base unit has an adapter housing with a channel formed therein, and wherein the adapter further comprises an engagement means on the second side of the adapter for nesting with the channel in the housing to as to connect the adapter body to the adapter housing.

15. The adapter for connecting the support arm of a satellite antenna to a base unit connected to a support surface of claim 14, wherein the adapter housing of the base unit has a plurality of flanges which extend into the channel, and wherein the adapter further comprises a flange disposed in the second side so as to engage the flanges of the housing as the adapter is slid thereinto to thereby hold the second end of the adapter body at least partially within the channel.

16. An adapter for connecting the support arm of a satellite antenna to a base unit connected to a support surface, the adapter comprising:

an adapter body having a first side configured for pivotable attachment to the support arm of the satellite antenna and a second side, opposite the first side, configured for releasable attachment to the base unit, wherein the base unit includes an adapter housing having a channel formed therein and having a plurality of inwardly extending flanges, and wherein the adapter further comprises at least one flange disposed about the second side for engaging the plurality of flanges in the adapter housing so as to hold the second side of the adapter within the adapter housing.

* * * * *